US009758298B2

(12) United States Patent
Cheng

(10) Patent No.: US 9,758,298 B2
(45) Date of Patent: Sep. 12, 2017

(54) PACKING BOX FOR LIQUID CRYSTAL GLASS PANEL

(71) Applicant: SHENZHEN CHINA STAR OPTOELECTRONICS TECHNOLOGY CO., LTD., Shenzhen, Guangdong (CN)

(72) Inventor: Jiahe Cheng, Shenzhen (CN)

(73) Assignee: Shenzhen China Star Optoelectronics Technology, Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 15/402,747

(22) Filed: Jan. 10, 2017

(65) Prior Publication Data

US 2017/0144826 A1 May 25, 2017

Related U.S. Application Data

(62) Division of application No. 14/375,692, filed as application No. PCT/CN2014/073154 on Mar. 10, 2014.

(30) Foreign Application Priority Data

Jan. 27, 2014 (CN) ..... 2014 1 0040936

(51) Int. Cl.
*B65D 85/00* (2006.01)
*B65D 85/48* (2006.01)
(Continued)

(52) U.S. Cl.
CPC ..... *B65D 85/48* (2013.01); *B65D 25/107* (2013.01); *B65D 81/053* (2013.01); *B65D 81/107* (2013.01)

(58) Field of Classification Search
USPC ..... 206/454, 455, 701, 722, 723, 725
See application file for complete search history.

(56) References Cited

U.S. PATENT DOCUMENTS

2008/0128310 A1 6/2008 Kao ..... 206/251
2008/0142396 A1 6/2008 Li et al. ..... 206/488
(Continued)

FOREIGN PATENT DOCUMENTS

CN 201128567 Y 10/2008
CN 101439778 A 5/2009
(Continued)

OTHER PUBLICATIONS

International Search Report dated Mar. 10, 2014, issued to PCT/CN2014/073154.

*Primary Examiner* — Jacob K Ackun
(74) *Attorney, Agent, or Firm* — Kim Winston LLP

(57) ABSTRACT

The present disclosure relates to a packing box for liquid crystal glass panel, including: a box body, the side walls of which cooperate with each other to form a placement area used for placing the liquid crystal glass panel; a supporting member; and a mounting groove formed on the inner side of at least one side wall of the box body for receiving the supporting member, wherein a mounting part capable of forming a complementary shape fit with the mounting groove is formed on one end of the supporting member, and a supporting part extending toward the placement area is formed on the other end of the supporting member. The packing box is provided with the supporting member on the inner side of the side wall of the box body, in order to support and position the liquid crystal glass panel through the good structural strength of the supporting member itself. The supporting member cooperates with the side walls of the box body on the two sides thereof to form a holding area, for placing the chip on film of the liquid crystal glass panel.
(Continued)

Therefore, the chip on film can be out of contact with the packing box, thus providing better protection for the liquid crystal glass panel.

8 Claims, 6 Drawing Sheets

(51) Int. Cl.
*B65D 25/10* (2006.01)
*B65D 81/05* (2006.01)
*B65D 81/107* (2006.01)

(56) References Cited

U.S. PATENT DOCUMENTS

2013/0270134 A1 10/2013 Chen ..... 206/320
2014/0097121 A1* 4/2014 Chen ..... B65D 85/48 206/586
2014/0102941 A1 4/2014 Zhao ..... 206/706
2014/0131240 A1 5/2014 Zhao ..... 206/451
2014/0138272 A1* 5/2014 Kuo ..... B65D 81/107 206/454
2014/0262927 A1* 9/2014 Guo ..... B65D 81/056 206/706
2014/0311935 A1* 10/2014 Yue ..... B65D 25/10 206/454
2014/0332422 A1* 11/2014 Hu ..... B65D 85/48 206/320
2014/0332432 A1* 11/2014 Zhou ..... B65D 85/48 206/454
2015/0041361 A1 2/2015 Hong ..... 206/723
2015/0101953 A1 4/2015 Yue ..... 206/454
2016/0001964 A1 1/2016 Yue ..... 206/555
2016/0114955 A1* 4/2016 Zhao ..... B65D 11/10 206/722

FOREIGN PATENT DOCUMENTS

CN 102673905 A 9/2012
CN 102774567 A 11/2012
CN 103204291 A 7/2013
CN 103523336 A 1/2014
JP H11-49267 A 2/1999
JP 2009-298421 A 12/2009
KR 10-2010-0078836 A 7/2010

* cited by examiner

PACKING BOX FOR LIQUID CRYSTAL GLASS PANEL

CROSS-REFERENCE TO RELATED APPLICATIONS

This application is a divisional of U.S. application Ser. No. 14/375,692, filed Jul. 30, 2014, which is a national stage of International Application No. PCT/CN2014/073154, filed Mar. 10, 2014, which claims the benefit of priority to Chinese Application No. 201410040936.7, filed Jan. 27, 2014, in the State Intellectual Property Office. All disclosures of the documents named above are incorporated herein in their entireties by reference.

FIELD OF THE INVENTION

The present disclosure relates to the technical field of package of liquid crystal glass panel, particularly to a packing box for liquid crystal glass panel.

BACKGROUND OF THE INVENTION

It is known that with the continuous development of liquid crystal display technology, ultrahigh resolution of a liquid crystal display device has become a trend. In order to improve the ultrahigh resolution of the liquid crystal display device, more chips and control circuits are necessary to be mounted on a liquid crystal glass panel. Therefore, more chips on films (referred to as COFs) will be formed on the side ends of the liquid crystal glass panel.

In the production process of the liquid crystal display device, the liquid crystal glass panel is generally placed in a packing box, and then transported to a corresponding assembly station for assembly. During transportation, damages to the liquid crystal glass panel should be avoided. Especially, the packing box should be prevented from damaging the chip on films on the liquid crystal glass panel. At present, a common packing box, as shown in FIG. 1 and FIG. 2, includes a box body 11, and the side walls 12 of the box body 11 cooperate with each other to form a placement area 13 for placing a liquid crystal glass panel 16 therein. A holding groove 14 is formed on the inner side of each side wall 12 of the box body 11, and corresponds to a chip on film 17 on the liquid crystal glass panel 16. Namely, after the liquid crystal glass panel 16 is placed in the placement area 13, the chip on film 17 will be exactly located in the holding groove 14. Meanwhile, a supporting projection 15 is formed between two adjacent holding grooves 14, for supporting and positioning the liquid crystal glass panel 16 and enabling the chip on film 17 out of contact with the packing box.

However, if the packing box adopts this structure, when the number of the chips on films formed on the side ends of the liquid crystal glass panel are increased, the holding grooves correspondingly provided on the side walls of the packing box will be increased as well. In this way, however, the thickness of the supporting projection formed between two adjacent holding grooves will be correspondingly decreased. Meanwhile, since the packing box is generally made from a foam material, when the thickness of the supporting projection is decreased to a certain extent, its own structural strength is not enough to support and position the liquid crystal glass panel. In the case of collision during transportation, the supporting projection is liable to bend, thereby resulting in direct collision between the chip on films and the liquid crystal glass panel. In this case, the liquid crystal glass panel will be damaged, and then the reject ratio of the liquid crystal glass panel will be increased.

SUMMARY OF THE INVENTION

Aiming at the defects in the prior art, the objective of the present disclosure is to provide a packing box for liquid crystal glass panel, which can provide better protection for a liquid crystal glass panel.

1) The packing box for liquid crystal glass panel according to the present disclosure includes: a box body, the side walls of which cooperate with each other to form a placement area used for placing the liquid crystal glass panel; a supporting member; and a mounting groove formed on the inner side of at least one side wall of the box body for receiving the supporting member, wherein a mounting part capable of forming a complementary shape fit with the mounting groove is formed on one end of the supporting member, and a supporting part extending toward the placement area is formed on the other end of the supporting member.

2) In one preferred embodiment of item 1) of the present disclosure, a plurality of mounting grooves is formed on the side wall and arranged at intervals.

3) In one preferred embodiment of item 1) of the present disclosure, the mounting grooves are formed on the side walls of the box body along a transverse direction.

4) In one preferred embodiment of item 3) of the present disclosure, a plurality of mounting grooves is formed on the side wall and arranged at intervals.

5) In one preferred embodiment of any one of items 1) to 4) of the present disclosure, the supporting part of the supporting member is constructed as a U-shaped structure, with the closed end of the supporting part toward the placement area; and the mounting part of the supporting member is constructed as a bent structure which is vertical to the open end of the supporting part.

6) In one preferred embodiment of item 5) of the present disclosure, the supporting member is formed by sheet-stamping.

7) In one preferred embodiment of any one of item 1) to 6) of the present disclosure, a buffering stop is arranged on the end face of the supporting member toward the placement area.

8) In one preferred embodiment of item 7) of the present disclosure, the buffering stop is adhered to the supporting member.

9) In one preferred embodiment of item 7) of the present disclosure, the buffering stop is made from silica gel or an ethylene-vinyl acetate copolymer.

Compared with the prior art, the packing box for liquid crystal glass panel according to the present disclosure is provided with the supporting member on the inner side of the side wall of the box body, in order to support and position the liquid crystal glass panel through the good structural strength of the supporting member itself. The supporting member cooperates with the side walls of the box body on the two sides thereof to form a holding area, for placing the chip on film of the liquid crystal glass panel. Therefore, the chip on film can be out of contact with the packing box, thus providing better protection for the liquid crystal glass panel.

In addition, the supporting member is arranged on the side wall of the box body. Therefore, the number and positions of the side walls provided with the supporting members can be flexibly controlled, and the number and positions of the supporting members arranged on one side wall can be flexibly controlled also. Consequently, the packing box can fit for the storage of different liquid crystal glass panels, thus enhancing the universality of the packing box.

In a further technical solution, a plurality of mounting grooves is formed on the side wall, so that a plurality of supporting members can be placed on the inner side of the side wall. In addition, the plurality of supporting members is used for supporting the liquid crystal glass panel, so as to effectively disperse the stress between the supporting members and the liquid crystal glass panel, thus avoiding damages to the liquid crystal glass panel and the supporting members due to stress concentration. Therefore, the packing box can provide better protection for the liquid crystal glass panel.

In a further technical solution, the supporting part of the supporting member is constructed as a U-shaped structure, and the mounting part thereof is constructed as a bent structure which is vertical to the open end of the supporting part. Therefore, since the supporting part is constructed as the U-shaped structure, the contact area between the supporting part and the liquid crystal glass panel can be increased on the condition of saving materials as many as possible, so that the supporting member can better support the liquid crystal glass panel. Since the mounting part is vertical to the supporting part, the stability of installing the supporting member on the side wall of the box body can be effectively guaranteed.

In a further technical solution, the supporting member is formed by sheet-stamping. By means of which, the supporting member is convenient for volume production, thereby saving the cost.

In a further technical solution, a buffering stop is arranged on the end face of the supporting member toward the placement area. Therefore, an impact force generated in the case of collision between the liquid crystal glass panel and the supporting member can be effectively reduced by the buffering stop, so that the packing box can provide better protection for the liquid crystal glass panel.

In a further technical solution, the buffering stop is adhered to the supporting member, thereby facilitating installation.

The above-mentioned technical features may be combined together in various appropriate manners or substituted by equivalent technical features, as long as the objectives of the present disclosure can be fulfilled.

BRIEF DESCRIPTION OF THE DRAWINGS

The present disclosure will be illustrated in more detail below based on nonfinite examples with reference to the accompanying drawings, in which.

LIST OF REFERENCE NUMBERS

11—box body, 12—side wall, 13—placement area, 14—holding groove, 15—supporting projection, 16—liquid crystal glass panel, 17—chip on film;

2—box body, 21—side wall, 22—mounting groove;

3—supporting member, 31—mounting part, 33—supporting part;

4—buffering stop;

5—liquid crystal glass panel, 51—chip on film.

DETAILED DESCRIPTION OF THE EMBODIMENTS

In order to enable the objectives, technical solutions and advantages of the present disclosure self-evident, a clear and complete description of technical solutions of the present disclosure will be given below. All of other embodiments, obtained by those of ordinary skill in the art based on the specific embodiments in the present disclosure without any creative effort, will also fall into the scope of the present disclosure.

At the outset, directional terms used in the present disclosure are defined as follows. In a packing box for liquid crystal glass panel as shown in FIG. 3, a vertical line drawn between the top and bottom sides of a liquid crystal glass panel is defined as a longitudinal direction L, and a vertical line drawn between two opposite side walls thereof is defined as a transverse direction T.

Figure 1:
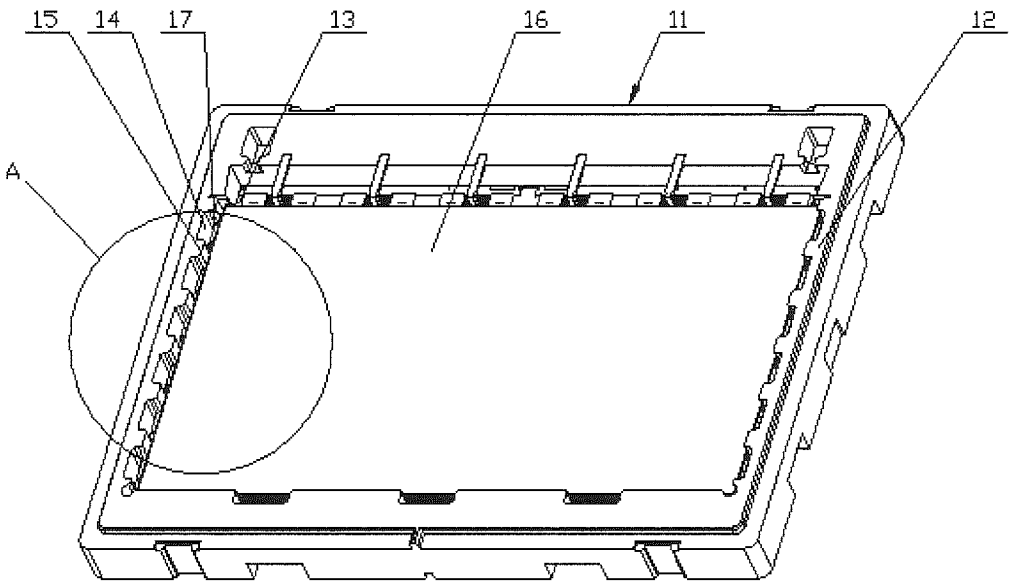
FIG. 1 is a schematic diagram of a structure of a packing box for liquid crystal glass panel in the prior art.
Figure 2:
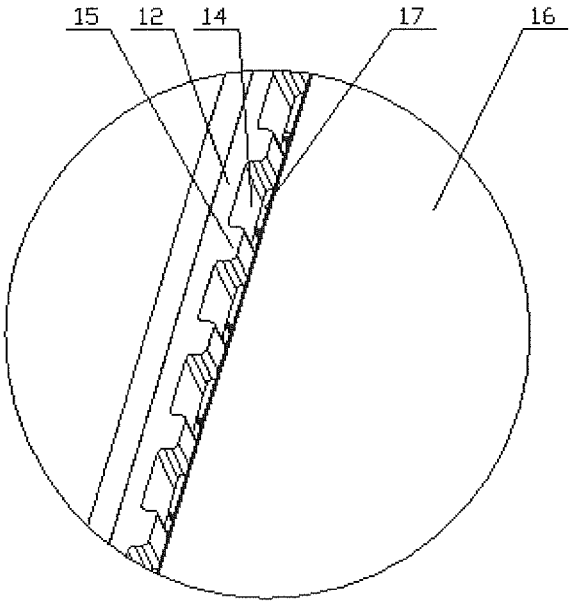
FIG. 2 is a partially enlarged view at area A in FIG. 1.
Figure 3:
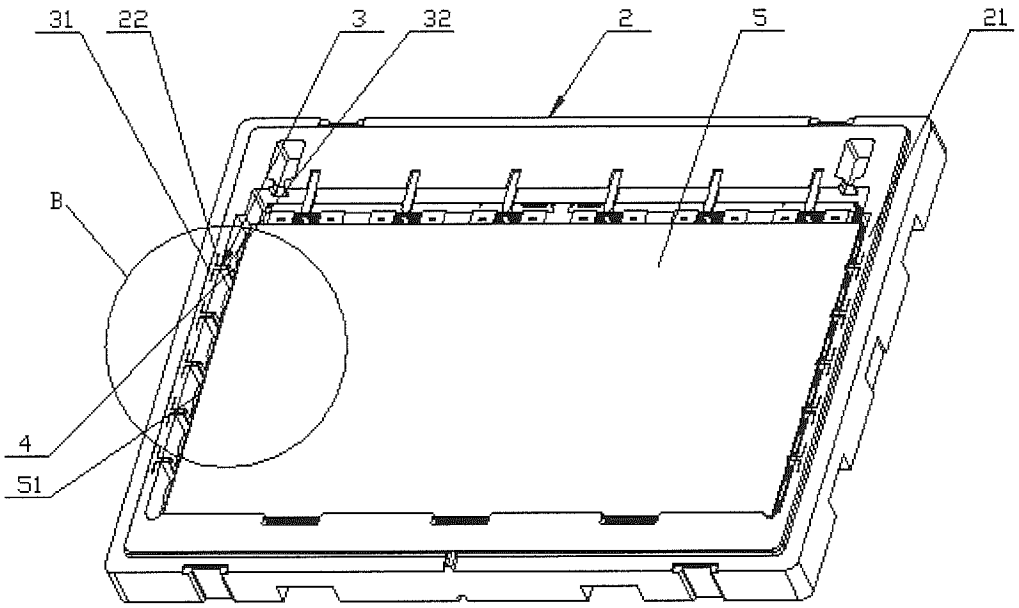
FIG. 3 schematically shows a structure of a packing box for liquid crystal glass panel according to an example of the present disclosure.
Figure 4:
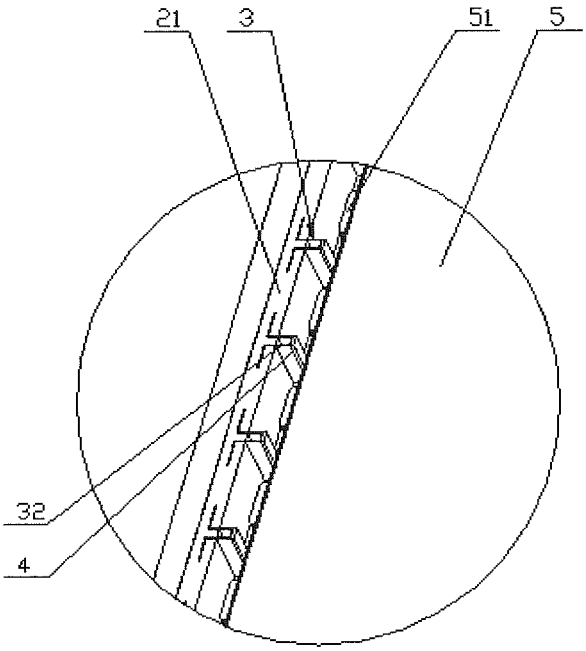
FIG. 4 is a partially enlarged view at area B in FIG. 3.
Figure 5:
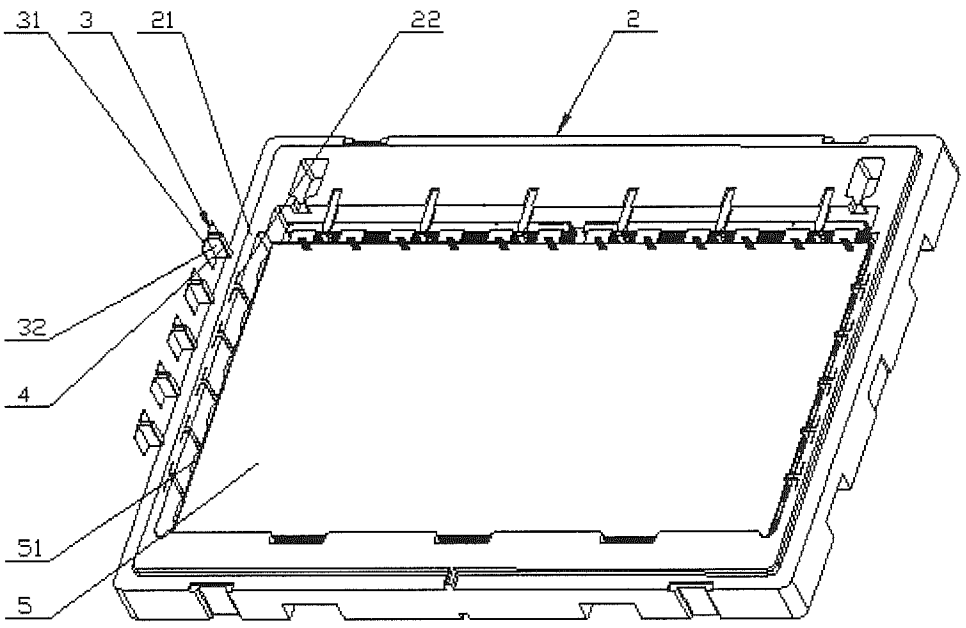
FIG. 5 schematically shows an installation structure of a packing box for liquid crystal glass panel according to an example of the present disclosure.

As shown in FIG. 3 to FIG. 5, the packing box for liquid crystal glass panel according to the example includes a box body 2, the side walls 21 of which cooperates with each other to form a placement area used for placing the liquid crystal glass panel 5. The packing box for liquid crystal glass panel further includes at least one supporting member 3, and at least one mounting groove 22 formed on the inner side of at least one side wall 21 of the box body 2 and used for receiving a corresponding supporting member 3 therein. A mounting part 31 capable of forming a complementary shape fit with the mounting groove 22 is formed on one end of the supporting member 3, and a supporting part 32 extending towards the placement area is formed on the other end of the supporting member 3.

It should be noted that there may be one side wall 21 provided with the mounting groove 22, or two (two adjacent side walls 21 or two opposite side walls 21), or three, or four side walls are provided with the mounting groove 22. Thus the number of the side walls 21 that can be provided with the mounting groove 22 can be varied, and meanwhile, the specific positions of the side walls 21 provided with the mounting groove 22 can be varied as well, and should be determined according to the liquid crystal glass panel 5 to be installed and used in practice. That is, when a chip on film 51 is formed on the side end of the liquid crystal glass panel 5, the mounting groove 22 should be arranged on the side wall 21 of the box body 2 toward said side end.

In addition, it should be further noted that, the specific number of the mounting grooves 22 on the side walls 21 can be one or more, and should be selected according to actual installation and application requirements.

It should be understood that on the side walls 21 provided with the mounting grooves 22, the number of the mounting grooves 22 should be larger than or equal to that of the supporting members 3 actually provided. Specifically, the number of the mounting grooves 22 arranged can be the same as that of the actually provided supporting members 3, and thus one-to-one cooperative installation can be achieved. The number of the disposed mounting grooves 22 can also be larger than that of the actually provided supporting members 3. Therefore, the supporting members 3 can be selectively placed in suitable mounting grooves 22 according to the actual condition of the liquid crystal glass panel 5 to be placed in actual use.

The supporting member 3 is arranged on the inner side of the side wall 21 of the box body 2, in order to support and position the liquid crystal glass panel 5 through the good structural strength of the supporting member 3 per se. The supporting member 3 cooperates with the side walls 21 of the box body 2 on the two sides thereof to form a holding area, which is used for placing the chip on film 51 on the liquid crystal glass panel 5, so as to ensure the chip on film 51 being out of contact with the packing box. Thus, better protection can be achieved for the liquid crystal glass panel 5.

In the meantime, through arrangement of the supporting member 3 on the side wall 21 of the box body 2, the number and positions of the side walls 21 provided with the supporting members 3 can be flexibly controlled, and the number and positions of the supporting members 3 arranged on one single side wall 21 can be flexibly controlled also. Consequently, the packing box can fit for the storage of different liquid crystal glass panels 5, thus enhancing the universality of the packing box.

In the example, on the side wall 21 provided with the mounting grooves 22, there may be one mounting groove 22, within which the supporting member 3 is mounted. Then, the liquid crystal glass panel 5 can be supported and positioned by the supporting member 3. In addition, the supporting member 3 cooperates with the side walls 21 of the box body 2 on the two sides thereof to form the holding area, for placing the chip on film 51 of the liquid crystal glass panel 5. However, in this manner, one side end of the liquid crystal glass panel 5 will only contact one supporting member 3. In the case of collision during transportation, the impact force applied to the liquid crystal glass panel 5 will be concentrated at the area of the supporting member 3, resulting in harm even damage to the liquid crystal glass panel 5 easily. Therefore, preferably, a plurality of mounting grooves 22 can be formed on one side wall 21, and arranged at intervals as shown in FIG. 3. Since the plurality of mounting grooves 22 are formed on one single side wall 21, a plurality of supporting members 3 can be placed on the inner side of the side wall 21 for supporting the liquid crystal glass panel 5, so as to effectively disperse the stress between the supporting members 3 and the liquid crystal glass panel 5, thus avoiding damages to the liquid crystal glass panel 5 and the supporting members 3 due to stress concentration. Therefore, the packing box can provide better protection for the liquid crystal glass panel 5.

In the example, the mounting grooves 22 can be formed on all four side walls 21 of the packing box for liquid crystal glass panel. Namely, the mounting grooves 22 are formed on the side walls 21 along the longitudinal direction (i.e., the top and bottom sides of the liquid crystal glass panel 5) and the side walls 21 along the transverse direction. In actual use, however, since some protection structures (used for protecting electronic devices arranged on the top and bottom sides) should be arranged on the side walls 21 corresponding to the top and bottom sides of the liquid crystal glass panel 5 of the packing box for liquid crystal glass panel, no mounting groove 22 can be disposed here, and the supporting member 3 is also prevented. Therefore, in the example, the mounting grooves 22 can be preferably formed only on the side walls 21 of the box body 2 along the transverse direction.

Further, a plurality of mounting grooves 22 are formed on each side wall 21, and arranged at intervals.

In this case, the specific number of the mounting grooves 22 and the installation number and manner of the supporting members 3 are similar to those as mentioned above, and will not be repeated redundantly herein.

In the example, the supporting member 3 can be of a plurality of structures in the specific form. For example, the supporting member 3 can be constructed as a T-shaped structure, with the extending end thereof used as the supporting part 32 and the other end thereof used as the mounting part 31 to be snapped into the mounting groove 22 of the side wall 21. As another example, the supporting member 3 can also be constructed as a cuboid, with one end thereof inserted into the mounting groove 22 on the side wall 21 and the other end thereof used as the supporting part 32, wherein the supporting member 3 is prevented from disengaging from the mounting groove 22 through the friction force between the supporting member 3 and the side wall 21. Also for example, the supporting member 3 can be constructed as a structure similar to T-shape, with one end thereof supporting a wedge-shaped structure and used as the mounting part 31 to be snapped into the mounting groove 22 of the side wall 21, and the other end thereof extending as the supporting part 32. Therefore, the specific structure of the supporting member 3 can be varied.

Moreover, the supporting member 3 can be supported by a flexible material with certain structural strength, for example, rubber, as long as the structural strength thereof is sufficient to support the liquid crystal glass panel 5 during collision, and the elasticity thereof does not damage the liquid crystal glass panel 5.

Figure 6:
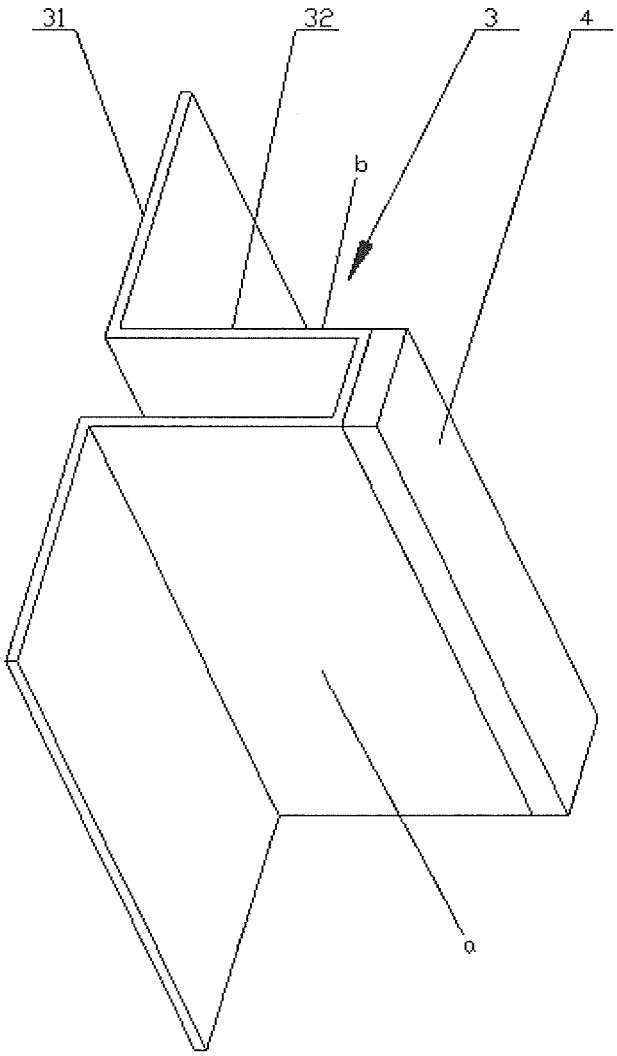
FIG. 6 schematically shows a structure of a supporting member of a packing box for liquid crystal glass panel according to an example of the present disclosure.

In the example, as shown in FIG. 6, the supporting part 32 of the supporting member 3 is preferably constructed as a U-shaped structure, with the closed end thereof toward the placement area, and the mounting part 31 of the supporting member 3 is constructed as a bent structure which is vertical to the open end of the supporting part 32. Therefore, by configuring the supporting part 32 as the U-shaped structure, the contact area between the supporting part 32 and the liquid crystal glass panel 5 can be increased on the premise of saving material as much as possible, so that the supporting member 3 can better support the liquid crystal glass panel 5. Since the mounting part 31 is vertical to the supporting part 32, the installation stability of the supporting member 3 and the side wall 21 of the box body 2 can be effectively guaranteed.

Further, with the supporting member 3 constructed as the above shape, the supporting member 3 can be formed by sheet-stamping. Thus volume production is facilitated and the cost is saved.

In the example, during transportation, the supporting member 3 will directly contact the liquid crystal glass panel 5 and is applied with a corresponding impact force in the case of collision. In order to reduce the impact force in the case of collision between the liquid crystal glass panel 5 and the supporting member 3, as shown in FIG. 5 and FIG. 6, a buffering stop 4 can be further arranged on the end face of the supporting member 3 toward the placement area.

In this case, the buffering stop 4 is preferably arranged on the end face of the supporting part 32 of the supporting member 3 toward the liquid crystal glass panel 5, as shown in FIG. 6. Thus a buffering function can be achieved between the liquid crystal glass panel 5 and the supporting member 3.

Further, the buffering stop 4 can be further arranged on the end face of the supporting part 32 of the supporting member 3 toward the chip on film 51 of the liquid crystal glass panel 5, namely at area a and area b as shown in FIG. 6. Thus a buffering function can be achieved between the chip on film 51 and the supporting member 3, thereby protecting the chip on film 51.

It should be understood that, the above-mentioned arrangements of the buffering stop 4 shall fall into the scope of the present disclosure.

In the example, the buffering stop 4 can be adhered to the supporting member 3, thereby significantly facilitating installation thereof.

In the example, the buffering stop 4 can be made from silica gel or an ethylene-vinyl acetate copolymer.

Finally, it should be noted that the above-mentioned embodiments and examples are merely used for illustrating instead of limiting the technical solutions of the present disclosure. Although the present disclosure has been described in detail with reference to the foregoing embodiments and examples, those of ordinary skill in the art should understand that they could still make modifications to the technical solutions recited in the foregoing embodiments or examples or make equivalent substitutions to a part of technical features therein. And these modifications or substitutions do not make the essence of the corresponding technical solutions depart from the spirit and scope of the technical solutions of the embodiments or examples of the present disclosure.

The invention claimed is:

1. A packing box for liquid crystal glass panel, including:

a box body, side walls of which cooperate with each other to form a placement area used for placing the liquid crystal glass panel;

a supporting member; and a plurality of mounting grooves formed on an inner side of at least one of the side walls of the box body and arranged at intervals, for receiving the supporting member;

wherein:

a mounting part capable of forming a complementary shape fit with the mounting groove is formed on one end of the supporting member, and a supporting part extending toward the placement area is formed on the other end of the supporting member, the supporting part of the supporting member is constructed as a U-shaped structure, with a closed end of the supporting part facing toward the placement area, and the mounting part of the supporting member is constructed as a bent structure which is vertical to an open end of the supporting part.

2. The packing box for liquid crystal glass panel according to claim 1, wherein the supporting member is formed by sheet-stamping.

3. The packing box for liquid crystal glass panel according to claim 1, wherein a buffering stop is arranged on an end face of the supporting member toward the placement area.

4. The packing box for liquid crystal glass panel according to claim 1, wherein the buffering stop is adhered to the supporting member.

5. The packing box for liquid crystal glass panel according to claim 3, wherein the buffering stop is made from silica gel or an ethylene-vinyl acetate copolymer.

6. The packing box for liquid crystal glass panel according to claim 1, wherein:

the mounting grooves are formed on the side walls of the box body along a transverse direction.

7. The packing box for liquid crystal glass panel according to claim 6, wherein the supporting member is formed by sheet-stamping.

8. The packing box for liquid crystal glass panel according to claim 7, wherein a buffering stop is arranged on an end face of the supporting member toward the placement area.

* * * * *